United States Patent [19]

Ortolano

[11] Patent Number: 5,062,769

[45] Date of Patent: Nov. 5, 1991

[54] CONNECTOR FOR TURBINE ELEMENT

[76] Inventor: Ralph J. Ortolano, 3776 Coolheights Dr., Rancho Palos Verdes, Calif. 90274

[21] Appl. No.: 440,239

[22] Filed: Nov. 22, 1989

[51] Int. Cl.[5] ..... F01D 5/32

[52] U.S. Cl. ..... 416/217; 416/220 R

[58] Field of Search ..... 416/220 RA, 204 RA, 416/217; 403/24; 29/889.21, 889.22

[56] References Cited

U.S. PATENT DOCUMENTS

| | | | |
|---|---|---|---|
| 1,289,278 | 12/1918 | Schmidt | 416/217 |
| 1,345,642 | 7/1920 | Schmidt | 416/217 |
| 4,135,849 | 1/1979 | Pigott | 416/217 |
| 4,321,012 | 3/1982 | Tan et al. | 416/217 |

FOREIGN PATENT DOCUMENTS

| | | | |
|---|---|---|---|
| 130711 | 10/1979 | Japan | 416/217 |
| 145804 | 11/1979 | Japan | 416/217 |
| 153907 | 12/1979 | Japan | 416/217 |
| 2066904 | 7/1981 | United Kingdom | 416/200 A |

*Primary Examiner*—John T. Kwon

*Attorney, Agent, or Firm*—Charles Berman

[57] ABSTRACT

Steam turbine blades and buckles are attached to a rotor with pins which fit through dove-tailed connections. In one extremity of the blade and a mating position on the rotor. The pins are composed of a first material which is in a state of compression due to shot peening, a second metallic material being on the surface of the pins. The second metallic material is not as hard as the first material and provides a relative lubricating surface to facilitate removal from a mating aperture in the dove-tail formations.

22 Claims, 1 Drawing Sheet

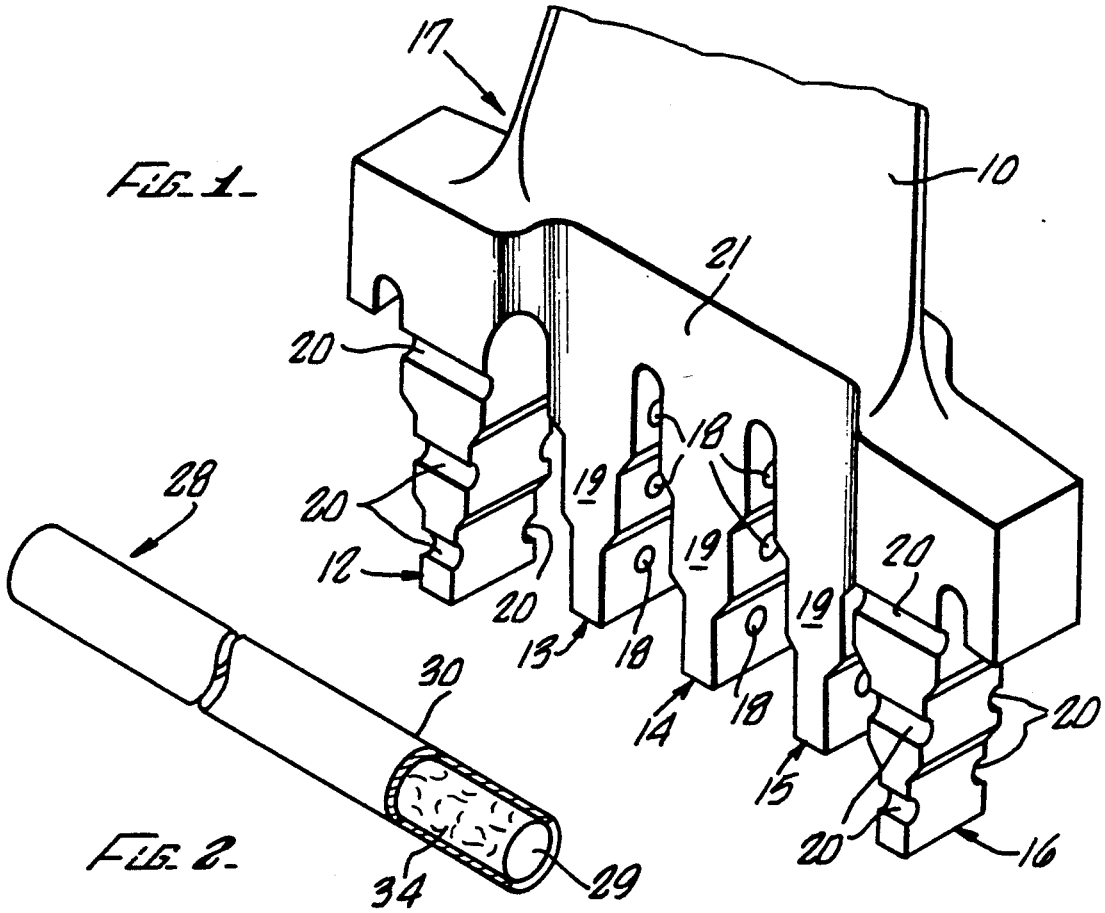
FIG. 1.
FIG. 2.
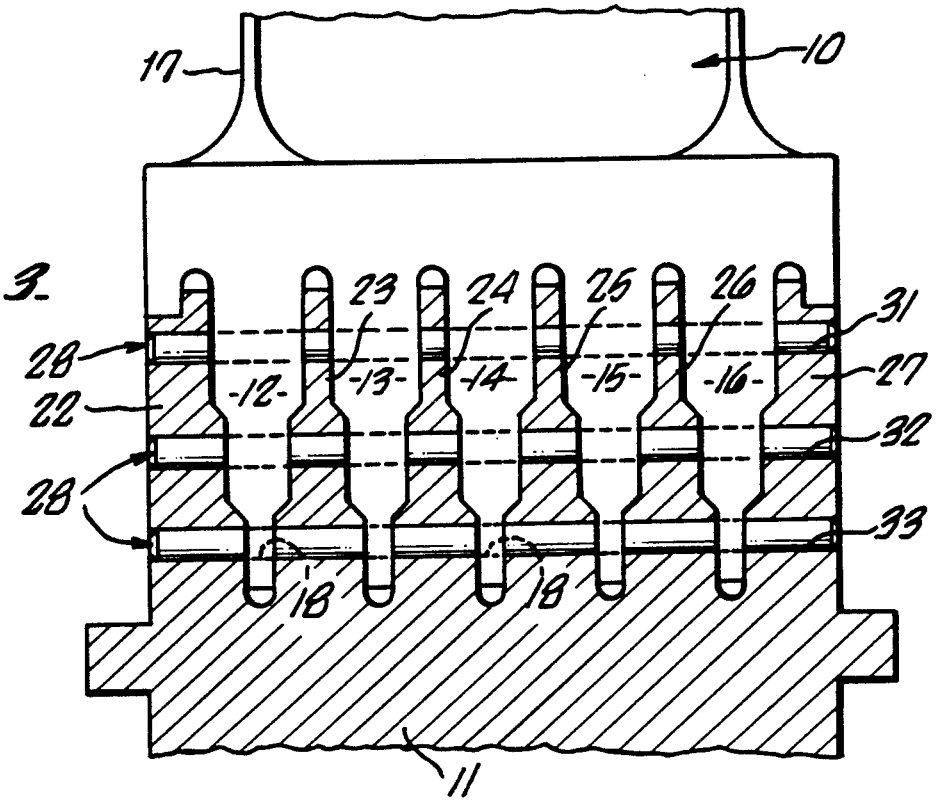
FIG. 3.

CONNECTOR FOR TURBINE ELEMENT

BACKGROUND

Turbine elements are connected to a rotor with pins which require long term duty cycles.

Pins for connecting these elements are prone to becoming jammed in apertures in the blade or rotor. Release of the elements is therefore time consuming and expensive. This invention seeks to overcome difficulties experienced with prior art pins.

SUMMARY

According to the invention a pin for connecting a first turbine element with the second turbine element is formed of a first metallic material and the surface of the pin is in a compression condition.

A layer of a second metallic material is applied to the surface as an alloy which provides for relative lubrication between the pin and an aperture into which the pin is located.

In a preferred form of the invention the second material is relatively less hard than the first material, and the second material is selectively aluminum, cadmium, zinc, bismuth, or other material sacrificial in the presence of iron, and may be pure or an alloy.

The invention is now further described with reference to the accompanying drawings.

DRAWINGS

FIG. 1 is a perspective view of a finger detail for a bucket or pocket of a turbine blade.

FIG. 2 is a finger dove-tail shown in location with a rotor shaft.

FIG. 3 is a perspective of a pin for connecting a bucket and rotor of a turbine.

DESCRIPTION

A first turbine element is a turbine blade or pocket vane 10 for connection with a rotor or wheel 11. The pocket vane at the extremity closest to the central axis of the turbine includes a finger dove-tail formation having five fingers 12, 13, 14, 15 and 16 directed from the end 17 of the vane 10. The three central fingers 13, 14 and 15 have three axially directed dove-tail pin holes 18. The pin holes are spaced at different distances from the end and are surrounded by material 19 constituting the fingers.

The outside extremity fingers 12 and 16 are each provided with six semicircular formations 20, three on either side and each spaced from each other. The spacing is parallel and aligned with the dove-tailed pin holes 18 in the three central fingers 13, 14 and 15. Pin holes 18 are radially aligned with the semicircular apertures 20 to one radial side of the fingers 12 and 16.

In construction a second dove-tail vane would be fitted into the dove-tail nest 21 so that central fingers adjacent bucket 10 will align with the front apertures 20 on the fingers 12 and 16. In this fashion the turbine blades of vane 10 are built up around the central axis of a steam turbine. The central axis contains the rotor or wheel 11 and their mating finger formations 22, 23, 24, 25, 26 and 27 which fit into the spaces formed between the fingers 12, 13, 14, 15 and 16 of the pocket 10. With the apertures 18 and 20 aligned in the manner described pins 28 are passed through the apertures 18 and 20.

The pins 28 are formed of a first metallic material 29 onto which is diffusion coated a second metallic material 30. The first metallic material 29 is relatively harder and tougher than the second metallic material 30. The first material is selectively iron, nickel, cobalt or other high strength allow. The second metallic material is sacrificial to iron and may be selectively an alloy or pure metal, such as aluminum, cadmium, zinc, or bismuth, which provides a relative lubricating interface with the apertures surfaces 18 and 20 of the bucket and corresponding apertures 31, 32 and 33 in the rotor. The thickness of the diffusion layer of the second metallic material can be in the range between 0.1 and 0.5 thousandths of an inch.

Prior to applying the diffusion layer to the pins 28, the surface 34 of the pin 28 is placed in compression by shot peening.

Crank shafting or distortion of the pins 28 at the shear planes between the interface of the fingers 22, 12, 23, 13, 24, 14, 25, 15, 26, 16, and 27 is reduced by using the metallic material 29 which is relatively harder and tougher. This characteristic of a harder material potentially renders the pins 28 more susceptible to stress corrosion cracking. Shot peening the surface and putting the pin in a compression state increases resistance to stress corrosion cracking. The thin diffusion layer 29 which is then applied sacrificially prevents corrosion attack of the pin 28 and the pin hole surfaces and provides a thin build-up of aluminum, if aluminum is used as the diffusion alloy. This aluminum would act to lubricate the pin on removal. The diffusion alloying process permits for a minimized coating thickness and uniform distribution on the surface 34 of the pin.

Many other examples of the invention exist each differing from the others in matters of detail only. The scope of the invention is to be determined solely by the following claims.

I claim:

1. A device for connecting a first turbine element with a second turbine element comprising a pin formed with a first metallic material, a surface of the pin being in a compression condition and a layer of a second metallic material on the surface of the pin, and wherein the first material is relatively harder than the second material, and the second material provides a lubricating outer surface to the pin.

2. A device as claimed in claim 1 wherein the second material is selectively aluminum, cadmium, zinc, bismuth, or other pure or ally material sacrificial in the presence of iron.

3. A device as claimed in claim 1 wherein the first material is selectively nickel, iron, cobalt, or other high strength alloy.

4. A device as claimed in claim 1 wherein the second material is diffusion coated onto the first material.

5. A device as in claim 4 where the second metallic material is diffusion coated to a thickness between 0.1 and 0.5 thousandths of an inch.

6. A device as claimed in claim 1 wherein the compression surface is effected by shot peening.

7. A device as claimed in claim 1 wherein the pin is a cylindrical rod.

8. A device as claimed in claim 7 wherein the pin is a dove tail pin for locking a rotor with a blade.

9. A combination of a turbine blade and rotor, a formation between the rotor and blade for interengagement, apertures between the formations for mating alignment and a plurality of pins through the apertures, the pins being formed of a first metallic material, a surface of the pins being in a compression condition, a layer of second metallic material being on the surface of the pins wherein the first material is relatively harder than the second material, the second material providing a relative lubricant surface between the apertures and the pin.

10. A combination as claimed in claim 9 wherein the second material is diffusion coated onto the first material and the compression surface of the first material is affected by shot peening.

11. A device for connecting a first turbine element with a second turbine element comprising a pin formed with a first metallic material, a surface of the pin being in a compression condition while the portion of the pin which is not the surface is in a non-compression condition and a layer of a second metallic material on the surface of the pin.

12. A device as claimed in claim 11 wherein the first material is relatively harder than the second material, and the second material is selectively aluminum, cadmium, zinc, bismuth, or other pure or alloy material sacrificial in the presence of iron.

13. A device as claimed in claim 12 wherein the second material provides a lubricating surface.

14. A device as claimed in claim 13 wherein the first material is selectively nickel, iron, cobalt, or other high strength alloy.

15. A method for connecting a turbine blade and a rotor including providing a formation on the blade and a formation on the rotor, interengaging the formation of the blade with the formation of the rotor, apertures being provided in the interengaging formations for mating alignment, inserting a plurality of pins through the apertures, the pins being formed of a first metallic material and having a surface in a compression condition, a layer of a second metallic material being on the surface of the pin, the second metallic material providing a lubricating surface thereby to facilitate removal of the pins from the apertures.

16. A method as claimed in claim 15 wherein the first material is relatively harder than the second material, and the second material is selectively aluminum, cadmium, zinc, bismuth, or other pure or alloy material sacrificial in the presence of iron.

17. A method as claimed in claim 16 wherein the first material is selectively nickel, iron, cobalt, or other high strength alloy.

18. A method as claimed in claim 16 wherein the second material is diffusion coated onto the first material.

19. A method as claimed in claim 15 wherein the compression surface is effected by shot peening.

20. A method for connecting a turbine blade and a rotor including providing a formation on the blade and a formation on the rotor, interengaging the formation of the blade with the formation of the rotor, apertures being provided in the interengaging formations for mating alignment, inserting a plurality of pins through the apertures, the pins being formed of a first metallic material and having a surface in a compression condition while the portion of the pin which is not the surface is in a non-compression condition, a layer of a second metallic material being on the surface of the pin, the second metallic material providing a lubricating surface thereby to facilitate removal of the pin from the apertures.

21. A method as claimed in claim 20 wherein the first material is relatively harder than the second material, and the second material is selectively aluminum, cadmium, zinc, bismuth, or other pure or alloy material sacrificial in the presence of iron.

22. A method as claimed in claim 21 wherein the first material is selectively nickel, iron, cobalt, or other high strength alloy.

* * * * *